US006082372A

United States Patent [19]

Mizukaki

[11] Patent Number: 6,082,372

[45] Date of Patent: Jul. 4, 2000

[54] DISPENSER CONTAINER FOR ROD-LIKE COSMETIC

[75] Inventor: Toru Mizukaki, Tokyo, Japan

[73] Assignee: Katsushika Co., Ltd., Tokyo, Japan

[21] Appl. No.: 09/225,480

[22] Filed: Jan. 6, 1999

[30] Foreign Application Priority Data

Jun. 19, 1998 [JP] Japan ..... 10-172778

[51] Int. Cl.[7] ..... A45D 40/06

[52] U.S. Cl. ..... 132/318; 401/78

[58] Field of Search ..... 132/318; 401/68, 401/69, 73, DIG. 1, 78; 206/385

[56] References Cited

U.S. PATENT DOCUMENTS

| | | | |
|---|---|---|---|
| 2,074,016 | 3/1937 | Coryell . | |
| 2,302,459 | 11/1942 | Noel . | |
| 2,309,000 | 1/1943 | Morrison . | |
| 2,395,535 | 2/1946 | Crane . | |
| 2,469,631 | 5/1949 | Broder . | |
| 3,230,860 | 1/1966 | Moore et al. | 132/318 |
| 4,961,663 | 10/1990 | Iwamoto et al. | 401/78 |
| 5,234,275 | 8/1993 | Gueret . | |
| 5,860,756 | 1/1999 | Fabrisi | 401/78 |

FOREIGN PATENT DOCUMENTS

| | | |
|---|---|---|
| 1085118 | 1/1955 | France . |
| 1303606 | of 1962 | France . |
| 56-136608 | 10/1981 | Japan . |
| 59-16009 | 1/1983 | Japan . |
| 61-35123 | 3/1984 | Japan . |
| 60-5616 | 1/1985 | Japan . |
| 60-33914 | 3/1985 | Japan . |
| 60-53208 | 4/1985 | Japan . |
| 63-125913 | 8/1988 | Japan . |
| 63-150615 | 10/1988 | Japan . |
| 2-25925 | 2/1990 | Japan . |
| 6-11610 | 2/1994 | Japan . |
| 6-11611 | 2/1994 | Japan . |
| 6-11612 | 2/1994 | Japan . |
| 6-11613 | 2/1994 | Japan . |
| 7-36922 | 7/1995 | Japan . |
| 8187122 | 7/1996 | Japan . |
| 10113224 | 5/1998 | Japan . |

OTHER PUBLICATIONS

An English language abstract of JP 8–187122.
An English language abstract of JP 10–113224.
An English language abstract of JP 56–136608.

(List continued on next page.)

*Primary Examiner*—Todd E. Manahan
*Attorney, Agent, or Firm*—Greenblum & Bernstein, P.L.C.

[57] ABSTRACT

A dispenser container for a rod-like cosmetic (1) comprises a cartridge body (A) accommodating the rod-like cosmetic (1) and including a holder cylinder (2) having a peripheral wall provided with engaging projections (3), and an inner body cylinder (4) in which the holder cylinder (2) is vertically movably arranged. The inner body cylinder (4) has a peripheral wall provided with guide slits (5) through which the engaging projections (3) extend, for guiding the holder cylinder (2) while preventing rotation relative to each other. The cartridge body (A) is inserted into a container main body (B) which includes a main body cylinder (14) and a sleeve (13) accommodated within the main body cylinder (14) so as to be rotatable and vertically movable within a predetermined range. The sleeve (13) has helical knurls (24) on its inner wall, which are engageable with the engaging projections (3) of the holder cylinder (2), and is arranged so that the upper end portion of the inner body cylinder (4) can be brought into abutment with the periphery of an opening (23) for the rod-like cosmetic (1) or with a stepped portion (40) on the inner wall in the upper portion of the sleeve (13). When the cartridge body (A) has been inserted into the container main body (B) and the base region (9) of the inner body cylinder (4) of the cartridge body (A) is detachably engaged within the main body cylinder (14) of the container main body (B), the sleeve (13) is pushed upwards to its upper limit position and retained in place so that the sleeve is rotatable but prevented from vertical movement.

12 Claims, 11 Drawing Sheets

OTHER PUBLICATIONS

An English language abstract of JP 59–16009.
An English language abstract of JP 60–5616.
An English language abstract of JP 60–33914.
An English language abstract of JP 60–53208.
An English language abstract of JP 61–35123.
An English language abstract of JP 63–125913.
An English language abstract of JP 63–150615.
An English language abstract of JP 2–25925.
An English language abstract of JP 6–11610.
An English language abstract of JP 6–11611.
An English language abstract of JP 6–11612.
An English language abstract of JP 6–11613.
An English language abstract of JP 7–36922.

DISPENSER CONTAINER FOR ROD-LIKE COSMETIC

BACKGROUND OF THE INVENTION

1. Field of the Invention

The present invention relates to a dispenser container for a rod-like cosmetic such as a lip stick, eyeliner and the like, which is accommodated inside of the container. More particularly, the present invention pertains to a dispenser container including a cartridge body for allowing the rod-like cosmetic to be replaced whenever desired, wherein the cartridge body can be produced with a high manufacturing efficiency and in a less expensive manner, and can be readily collected or recovered for recycling purpose.

2. Description of the Related Art

There have been various proposals made in respect of a so-called cartridge-type dispenser container for a rod-like cosmetic, in which a rod-like cosmetic is accommodated inside of a container provided with an internal dispensing mechanism, such that the rod-like cosmetic can be replaced whenever desired. An arrangement according to the applicant's earlier proposal is disclosed, for example, in Japanese Patent Application Laid-open Publication No. 10-113,224, in which the dispensing container for the rod-like cosmetic includes a cartridge body comprised of a holder cylinder and an inner body cylinder, as well as a container main body comprised of a sleeve, main body cylinder and a cap. In this instance, the inner body cylinder of the cartridge body has a lower portion which is detachably engaged into the main body cylinder of the container main body, and the sleeve can be slidingly moved downwards so as to remove the cartridge body from the container main body. In this instance, the cartridge body to be disposed is comprised essentially of the holder cylinder and the inner body cylinder, which is not exposed when it is mounted in the container main body. As a result, the cartridge body does not require any specific ornamental treatment and can be formed of a single material, so that the cartridge body can be produced with a high manufacturing efficiency and in a less expensive manner. Furthermore, when the cartridge body is to be disposed, it is possible readily to perform sorting and collection of the waste material for recycling purpose.

Moreover, it is possible to remove the cartridge body from the by the vertical movement of the sleeve. Thus, by operating the sleeve, the cartridge body can be readily removed even under an increased retaining force between the cartridge body and the container main body, which serves to completely prevent unintended removal of the cartridge body.

However, since the abutment portion for moving the cartridge body downwards is provided at the lower end of the sleeve, there exists a stepped abutment portion within the container main body. This results in that, when the cartridge body is not accurately inserted into the container main body, the tip end of the cartridge body tends to be engaged with the abutment portion so that the tip end of the components of the cartridge body or of the rod-like cosmetic may be subjected to damages. Also, due to the formation of the stepped portion on the outer peripheral surface of the cartridge body, it has been considered inevitable for the cartridge body to have an outer diameter which is unduly large.

Moreover, when the holder cylinder is to be assembled into the inner body cylinder, the engaging projections extending through the guide slits in the inner body cylinder obstruct the assembling operation. It was thus necessary for the upper end of the inner body cylinder to have cutouts which extends to the guide slits, such that the upper end of the inner body cylinder is radially expanded in order to allow the holder cylinder to be inserted into the inner body cylinder from the upper side. Such an arrangement, however, is not very appropriate because the inner body cylinder as a whole is exposed when the cartridge body alone is present, and there may be instances wherein the tip end of the inner body cylinder is deformed radially inwards and comes into contact with the rod-like cosmetic, thereby giving rise to damages to the rod-like cosmetic.

DISCLOSURE OF THE INVENTION

It is therefore an object of the present invention to provide an improved dispenser container for rod-like cosmetic, which serves to eliminate the abovementioned drawbacks of the conventional arrangement.

According to the present invention, there is provided a dispenser container for a rod-like cosmetic, comprising: a cartridge body which accommodates a rod-like cosmetic and includes a holder cylinder having a peripheral wall provided with engaging projections, and an inner body cylinder in which the holder cylinder is vertically movably arranged, said inner body cylinder having a peripheral wall provided with guide slits through which the engaging projections extend, for guiding said holder cylinder while preventing rotation relative to each other; and a container main body which includes a main body cylinder having an upper portion provided with a fitting portion for detachably fitting a cap, and a sleeve rotatably held by said main body cylinder and having an inner wall provided with helical knurls which are engageable with the engaging projections of the holder cylinder; said cartridge body being inserted into the container main body such that a base portion of said inner body cylinder of the cartridge body is detachably engaged within said main body cylinder of the container main body; said sleeve of the container main body being accommodated within said main body cylinder such that the sleeve is rotatable and vertically movable within a predetermined range, said sleeve having a peripheral portion which defines an opening and said inner body cylinder having an upper end which can be brought into abutment with said peripheral portion of the sleeve, such that said sleeve is retained in place in which the sleeve is rotatable but prevented from vertical movement, after said cartridge body has been inserted into said container main body and the sleeve has been pushed upwards to its upper limit position.

DESCRIPTION OF THE PREFERRED EMBODIMENTS

Figure 1:
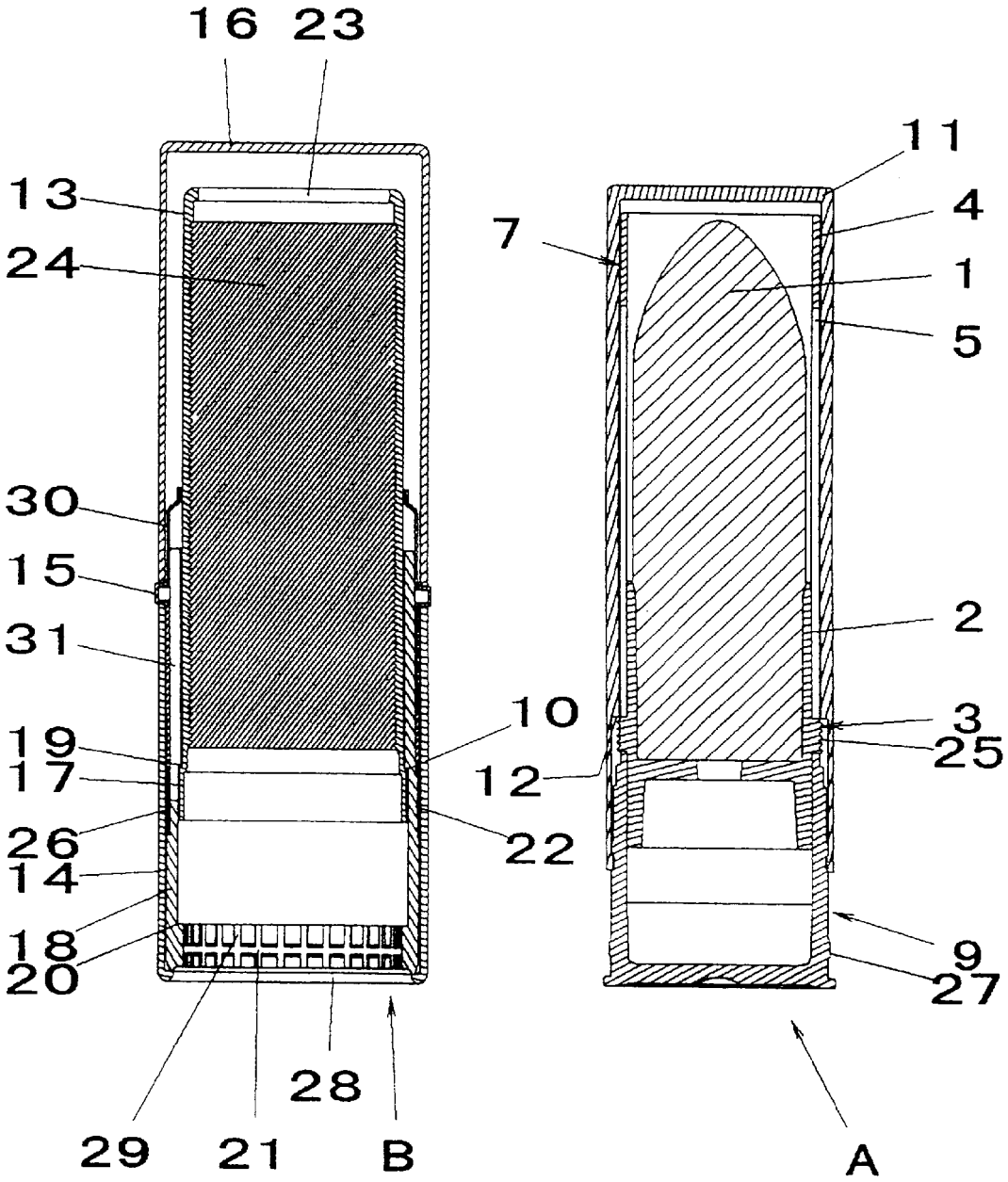
FIG. 1 is a longitudinal-sectional view showing a dispenser container for a rod-like cosmetic according to one embodiment of the present invention.

The present invention will now be explained in further detail hereinafter, with reference to the accompanying drawings.

A dispenser container for a rod-like cosmetic according to the present invention comprises a cartridge body A which accommodates a rod-like cosmetic 1 therein. The cartridge body 1 includes a holder cylinder 2 having a peripheral wall provided with engaging projections 3, and an inner body cylinder 4 in which the holder cylinder 2 is vertically movably arranged. The inner body cylinder 4 has a peripheral wall provided with guide slits 5 through which the engaging projections 3 extend, for guiding the holder cylinder 2 while preventing rotation relative to each other. The dispenser container according to the present invention further comprises a container main body B which includes a main body cylinder 14 having an upper portion provided with a fitting portion 30 for detachably fitting a cap 16, and a sleeve 13 rotatably held by the main body cylinder 14 and having an inner wall provided with helical knurls 24 which are engageable with the engaging projections 3 of the holder cylinder 2.

The cartridge body A is inserted into the container main body B such that a base portion 9 of the inner body cylinder 4 of the cartridge body A is detachably engaged within the main body cylinder 14 of the container main body B. The sleeve 13 of the container main body B is accommodated within the main body cylinder 14 such that the sleeve 13 is rotatable and vertically movable within a predetermined range. The sleeve 13 has a peripheral portion which defines an opening 23, and the inner body cylinder 4 has an upper end which can be brought into abutment with said peripheral portion of the sleeve, such that the sleeve 13 is retained in place in which the sleeve 13 is rotatable but prevented from vertical movement, after the cartridge body A has been inserted into the container main body B and the sleeve 13 has been pushed upwards to its upper limit position.

In the assembled state in which the cartridge body A has been inserted into the container main body B, the base portion 9 of the inner body cylinder 4 of the cartridge body A is secured in the main body cylinder 14 and the engaging projections 3 of the holder cylinder 2 are engaged with the helical knurls 24 of the sleeve 13. Also, the sleeve 13 which has been pushed upwards is retained in its upper limit position where it is rotatable but prevented from vertical movement. In this position of the sleeve, the tip end portion of the inner body cylinder 4 is in abutment with the periphery of the opening 23 in the sleeve 13, or with the stepped portion 40 formed on the inner wall of the sleeve 13 at its upper portion. By holding the main body cylinder 14 and rotating the sleeve 13, since the engaging projections 3 of the holder cylinder 2, which is prevented from rotation by the inner body cylinder 4 secured to the inside of the main body cylinder 14, are in engagement with the helical knurls 24 of the rotating sleeve 13, the holder cylinder 2 is caused to move vertically by the helical function so that the rod-like cosmetic 1 is dispensed from the container main body B When the cartridge body A is to be removed from the container main body B, the sleeve 13 is pushed downwards while holding the main body cylinder 14. As a result, since the tip end portion of the inner body cylinder 4 is in abutment with the periphery of the opening 23 in the sleeve 13, or with the stepped portion 40 formed on the inner wall of the sleeve 13 at its upper portion, the inner body cylinder 4 is pushed downwards to release the engagement between the main body cylinder 14 and the inner body cylinder 4, thereby allowing the inner body cylinder 14 to be removed from the main body cylinder 4. Thus, when the engaging projections 3 of the holder cylinder 2 are disengaged from the helical knurls 24 of the sleeve 13, it is possible to remove the cartridge body A from the container main body B.

When, on the other hand, the cartridge body A is to be mounted in the container main body B, the cartridge body A is inserted into the container main body B from its lower side. The engaging projections 3 of the holder cylinder 2 are engaged with the helical knurls 24 of the sleeve 13, and the base portion 9 of the inner body cylinder 4 is engaged into the main body cylinder 14 to complete is the mounting of the cartridge body A.

According to the preferred embodiment of the present invention shown in FIGS. 1 to 7, the lower end of a rod-like cosmetic 1, such as a lip stick or eyeliner, is fitted into, and held by the holder cylinder 2. The holder cylinder 2 has a peripheral wall provided with a pair of engaging projections 3 which are arranged at diametrically opposite locations relative to each other. In this instance, each engaging projection 3 extends in the circumferential direction of the holder cylinder 2 over a range which is not greater than one half of the peripheral length of the holder cylinder 2. The holder cylinder 2 is vertically slidably arranged within the inner body cylinder 4 in the manner to be more fully described below.

The inner body cylinder 4 has a peripheral wall which is formed with longitudinal guide slits 5. Each of the guide slits 5 extends in parallel with the center axis of the inner body cylinder 4, and has a width which corresponds to that of the engaging projection 3. The guide slits 5 are engageable with the respective projection 3 so as to guide the vertical movement of the holder cylinder 2 relative to the inner body cylinder 4, while preventing rotational movement therebetween. The upper and lower ends of the guide slits 5 are axially closed as upper and lower dead points of the holder cylinder 2. Thus, when the engaging projections 3 are brought into abutment with the upper or lower closed ends of the guide slits 5, it is possible to block the vertical displacement of the holder cylinder 2 or define the displacement amount thereof. There are formed horizontal extensions 6 in the form of circumferential slits in the peripheral wall of the inner body cylinder 4 and connected to the guide slits 5 at the upper and lower ends thereof. Each horizontal extension 6 has a width which corresponds to the height of the engaging projection 3 in the axial direction of the holder cylinder 2. When the upper or is lower extensions 6 are engaged by the relevant projections 3, the holder cylinder 2 can be retained in the upper or lower dead point. The radially outer edges of the engaging projections 3 extends outwards beyond the peripheral wall of the inner body cylinder 4. The region of the inner body cylinder 4 provided with the guide slits 5 serves as a guide portion 7. The lower region of the guide portion 7 is formed as a base region 9 having a slightly enlarged outer diameter. The base region 9 has an outer peripheral wall which is provided on its lower side with a plurality of engaging projections 27 which are arranged at a constant distance from each other.

Figure 7:
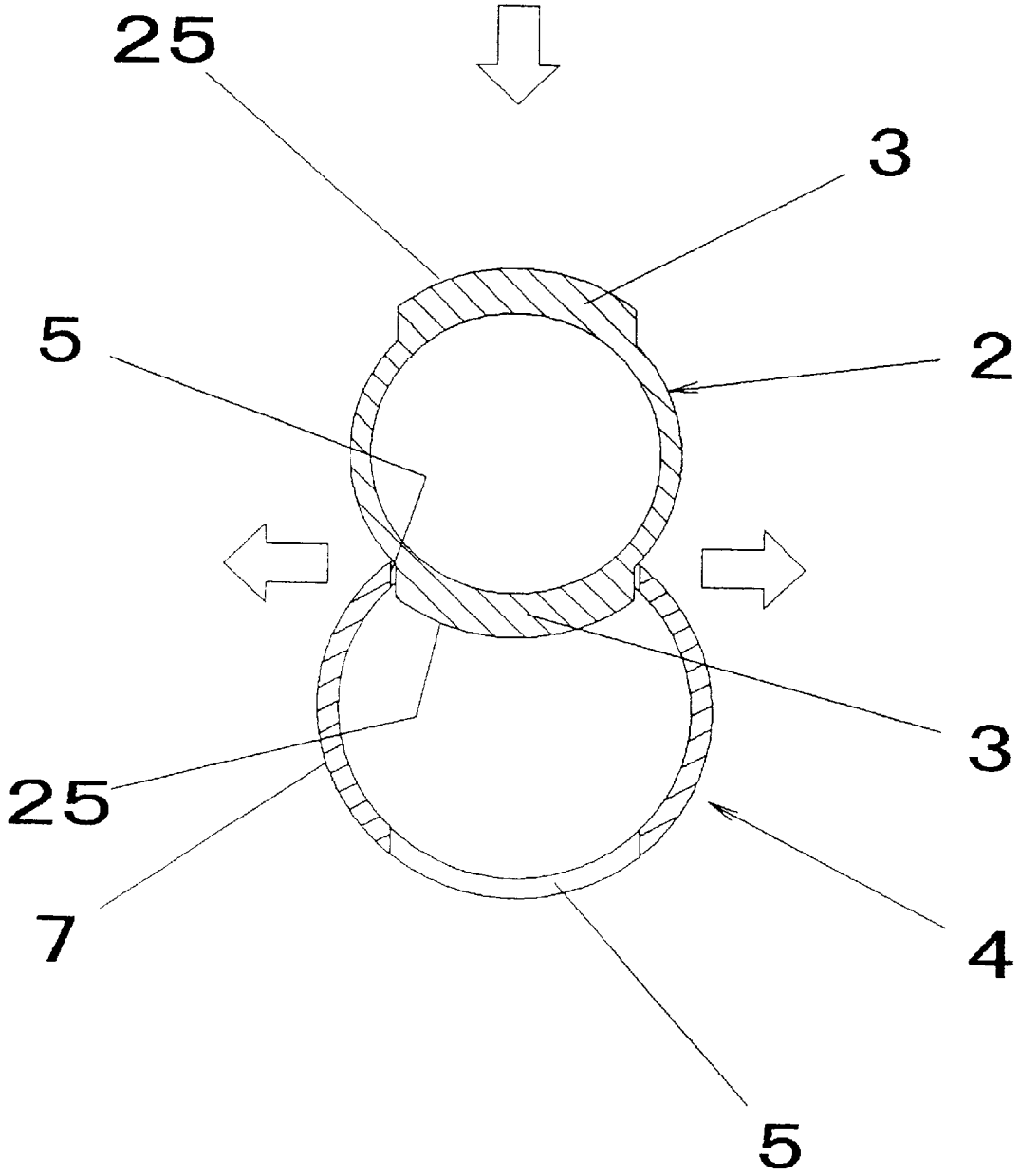
FIG. 7 is a cross-sectional view showing a state in which the holder cylinder is assembled with the inner body cylinder.

When the holder cylinder 2 is fitted into the inner body cylinder 4, as particularly shown in FIG. 7, the holder cylinder 2 is urged against the inner body cylinder 4 at its guide slit 5 having a large width such that the outer peripheral surface of the holder cylinder 2 is brought into abutment with the edges of the guide slit 5. By this, the slit 5 is enlarged by the holder cylinder 2 and the holder cylinder 2 can be forcibly inserted into the inner body cylinder 4. After the holder cylinder 2 has been inserted into the inner body cylinder 4, the inner body cylinder 4 resumes its original shape by its own resiliency, to retain the holder cylinder 2 without being disengaged.

Figure 6:
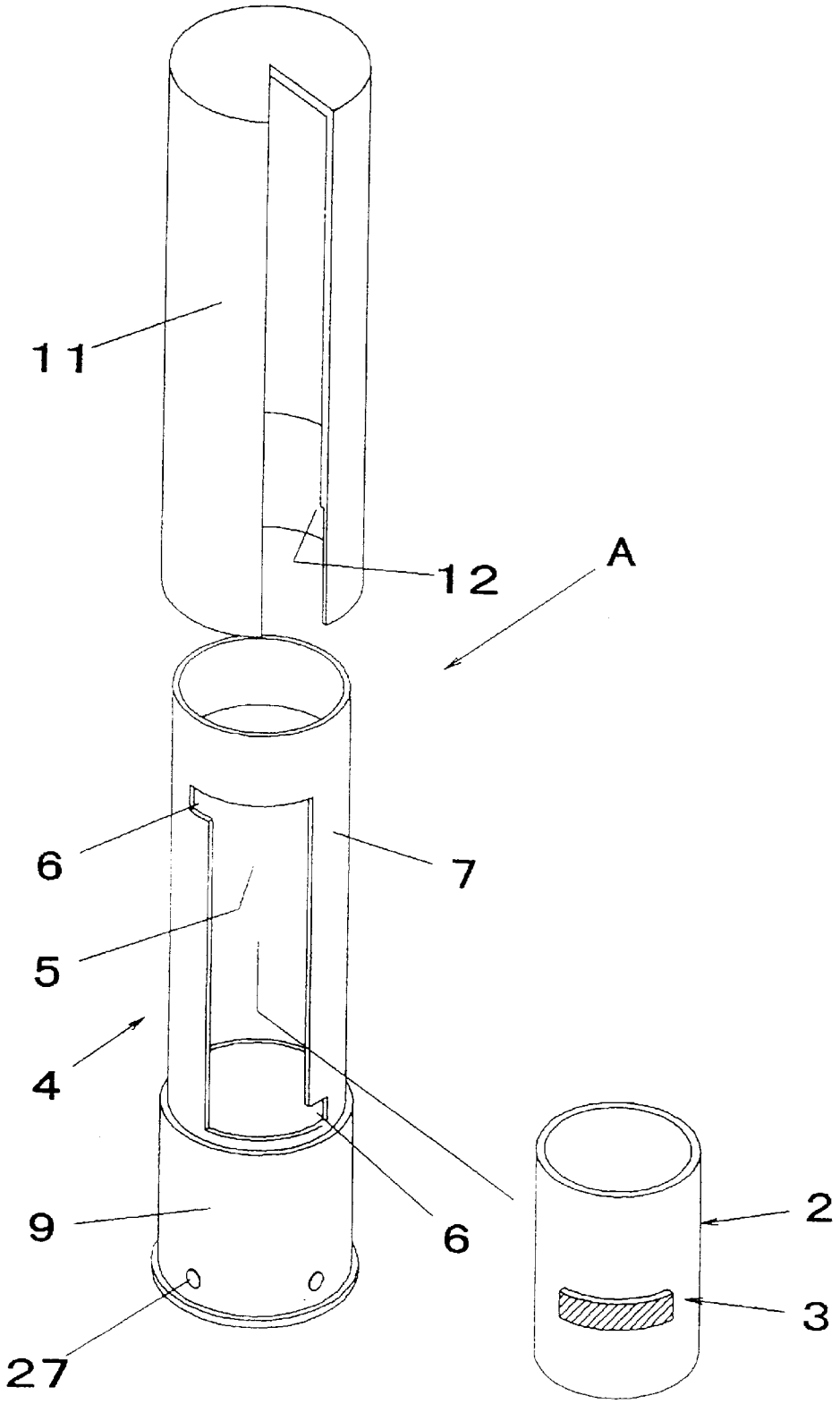
FIG. 6 is an exploded view of the cartridge body.

The holder cylinder 2 and the inner body cylinder 4 as a whole constitute the cartridge body A. When the cartridge body A alone is present, as shown in FIGS. 1 and 6, a transparent temporary cap 11 is fitted over the inner body cylinder 4 to protect the rod-like cosmetic 1 within the inner body cylinder 4. Specifically, the temporary cap 11 covers the guide portion 7 of the inner body cylinder 4 and is detachably fitted with the base region 9. The temporary cap 11 includes an inner wall having an inner diameter which is enlarged in its lower is region to form an abutment region 12. When the temporary cap 11 is fitted over the inner body cylinder 4, the engaging projections 3 of the holder cylinder 2 in their lower dead point are engaged with the abutment region 12. It is thus possible to prevent the holder cylinder from being raised within the temporary cap 11 so that the rod-like cosmetic 1 is brought into abutment with the inner surface of the temporary cap 11 and is damaged thereby.

In the next place, explanation will be made of the container main body B in which the cartridge body A is detachably accommodated. The container main body B is comprised of a sleeve 13, a main body cylinder 14, a fitting cylinder 15, and a cap 16.

The sleeve 13 has an upper end which is formed with an opening 23 for allowing passage of the rod-like cosmetic 1. The periphery of the opening 23 is engageable with the upper end of the inner body cylinder 4 when the inner body cylinder 4 is inserted into the sleeve 13. The inner wall of the sleeve 13 in its entirety is formed with a number of minute helical knurls 24. Each of the engaging projection 3 of the holder cylinder 2 has a radially outer surface 25 which is engageable with a plurality of helical knurls 24 which are adjacent to each other, such that the engaging projections 3 of the holder cylinder 2 can be engaged with the sleeve 3 at any desired location thereof. The lower portion of the sleeve 13 is formed as an increased diameter portion 17 with a slightly increased outer diameter, defining a stepped portion 10 above the increased diameter portion 17. The inner wall of the increased diameter portion 17 is free from the helical knurls 24 and has a slightly increased inner diameter. The increased diameter portion 17 of the sleeve 13 is accommodated inside of an inner cylinder 18.

The inner wall of the inner cylinder 18 has a diameter which is slightly larger than the outer diameter of the increased diameter portion 17 of the sleeve 13. The inner cylinder 18 is provided with an upper stopper 19 and a lower stopper 20 at the upper and lower portions of the inner wall, respectively, so as to limit the vertical movement of the sleeve 13 relative to the inner cylinder 18. The upper stopper 19 has an inner diameter which is slightly larger than the outer diameter of the sleeve 13, and smaller than the outer diameter of the increased diameter portion 17, such that the stepped portion 10 of the sleeve 13 is engageable with the upper stopper 19. The lower stopper 20 has an inner diameter which is substantially same as the outer diameter of the increased diameter portion 17, such that the lower end of the sleeve 13 is engageable with the lower stopper 20. The inner cylinder 18 is provided with a circumferential rib 21 at a location of the inner wall below the lower stopper 20, such that the engaging projections 27 of the inner body cylinder 4 an ride over the circumferential rib 21. Furthermore, on the upper and lower sides of the circumferential rib 21, there are formed longitudinal ribs 29 which are arranged in the circumferential direction as longitudinal knurls. These longitudinal ribs 29 are engageable with the engaging projections 27 of the inner body cylinder 4, such that the inner body cylinder 4 of the cartridge body A is engaged with the inner cylinder 18 of the casing main body B while being prevented from a relative rotation and also from a withdrawal therefrom. The arrangement of the engaging projections 27 at the inner body cylinder 4, and the circumferential rib 21 and the longitudinal ribs 29 at the inner cylinder 18 may be reversed. That is to say, it is possible to provide the engaging projections 27 for the inner cylinder 18 and the circumferential rib 21 and the longitudinal ribs 29 for the inner body cylinder 4. The inner cylinder 18 is provided with longitudinal cutouts 31 which extend from the upper end of the inner cylinder 18 to a location which is below the upper stopper 19. The increased diameter portion 17 of the sleeve 13 can be inserted into the inner cylinder 18, by radially expanding the upper portion of the inner cylinder 18 which is made possible due to the formation of the longitudinal cutouts 31. The inner cylinder 18 has an outer peripheral surface which is provided with outer peripheral knurls 22. The inner cylinder 18 is accommodated inside of the main body cylinder 14.

The main body cylinder 14 has an opening 28 in its lower surface, for allowing insertion and withdrawal of the cartridge body A, and an upper portion to which a fitting cylinder 15 is secured.

The fitting cylinder 15 has a lower portion which is fitted onto the upper portion of the inner cylinder 18, and an inner wall which is provided with inner peripheral knurls 26. The inner peripheral knurls 26 of the fitting cylinder 15 are engageable with the outer peripheral knurls 22 of the inner cylinder 18 so as to prevent rotation of the inner cylinder 18 relative to the fitting cylinder 15. The upper end of the fitting cylinder 15 protrudes upwards from the upper end of the main body cylinder 14 and serves as a fitting portion 30 over which the cap 16 is detachably fitted.

Figure 2:
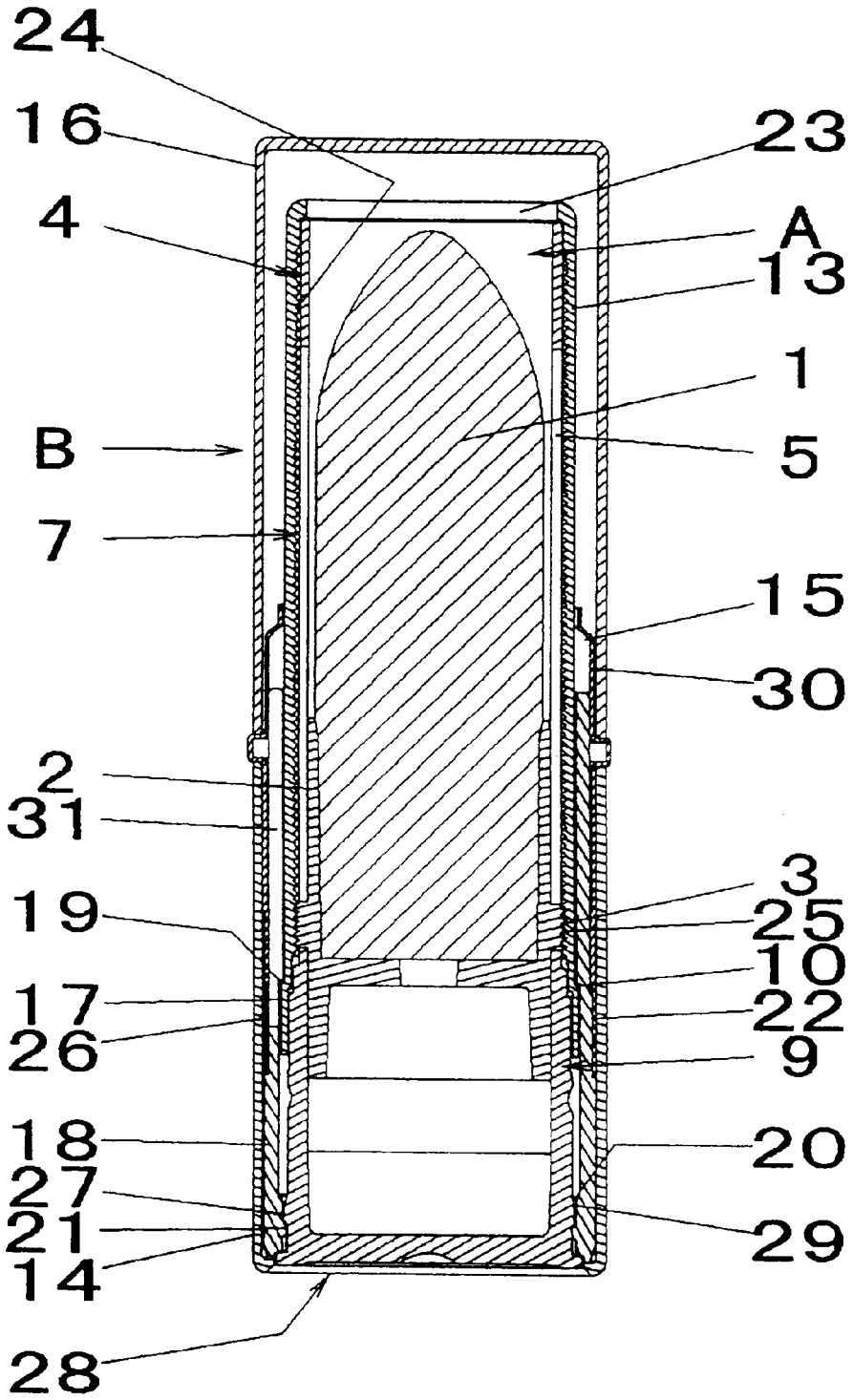
FIG. 2 is a longitudinal-sectional view showing a state in which the cartridge body is placed in the container main body.
Figure 3:
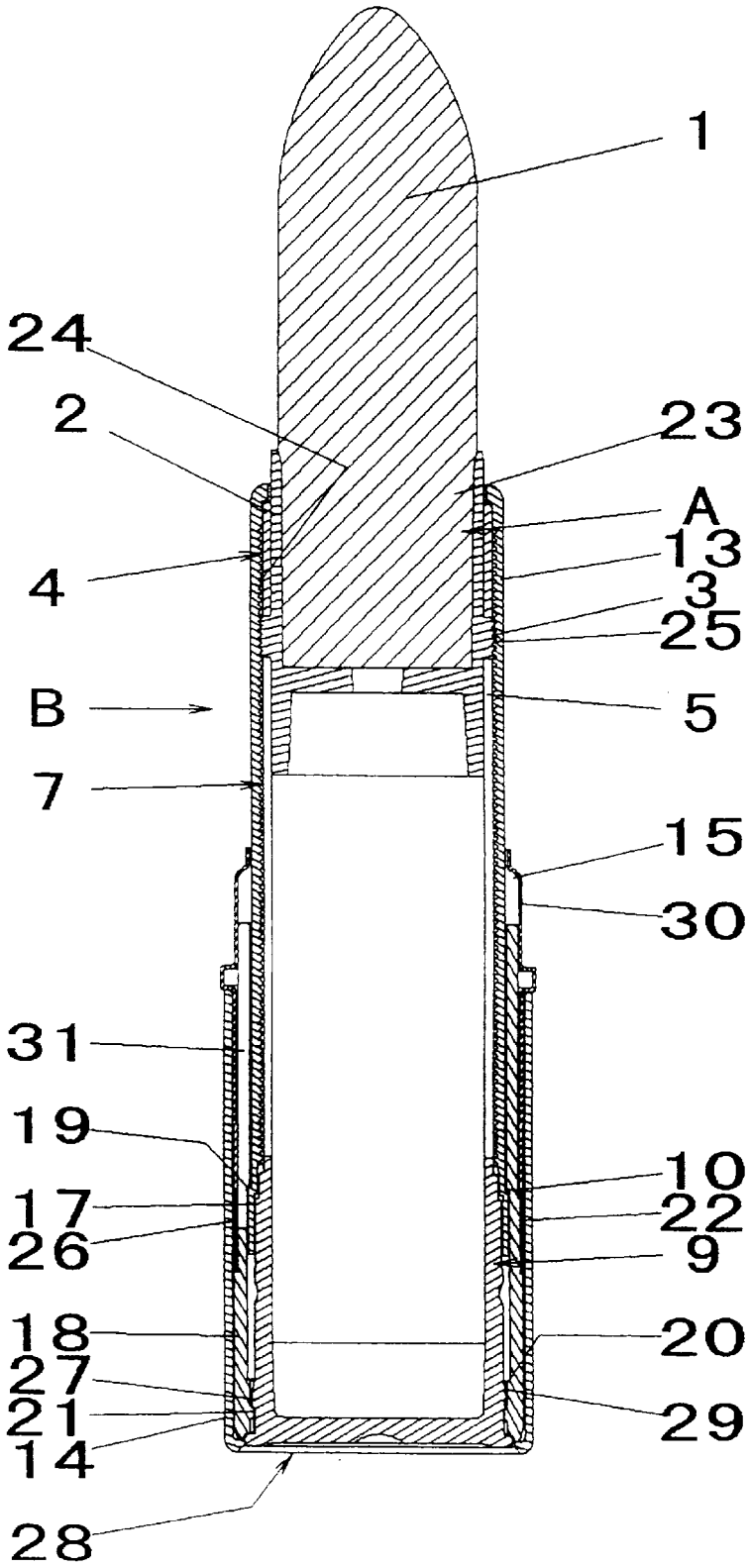
FIG. 3 is a longitudinal-sectional view showing a state in which the rod-like cosmetic has been projected.
Figure 4:
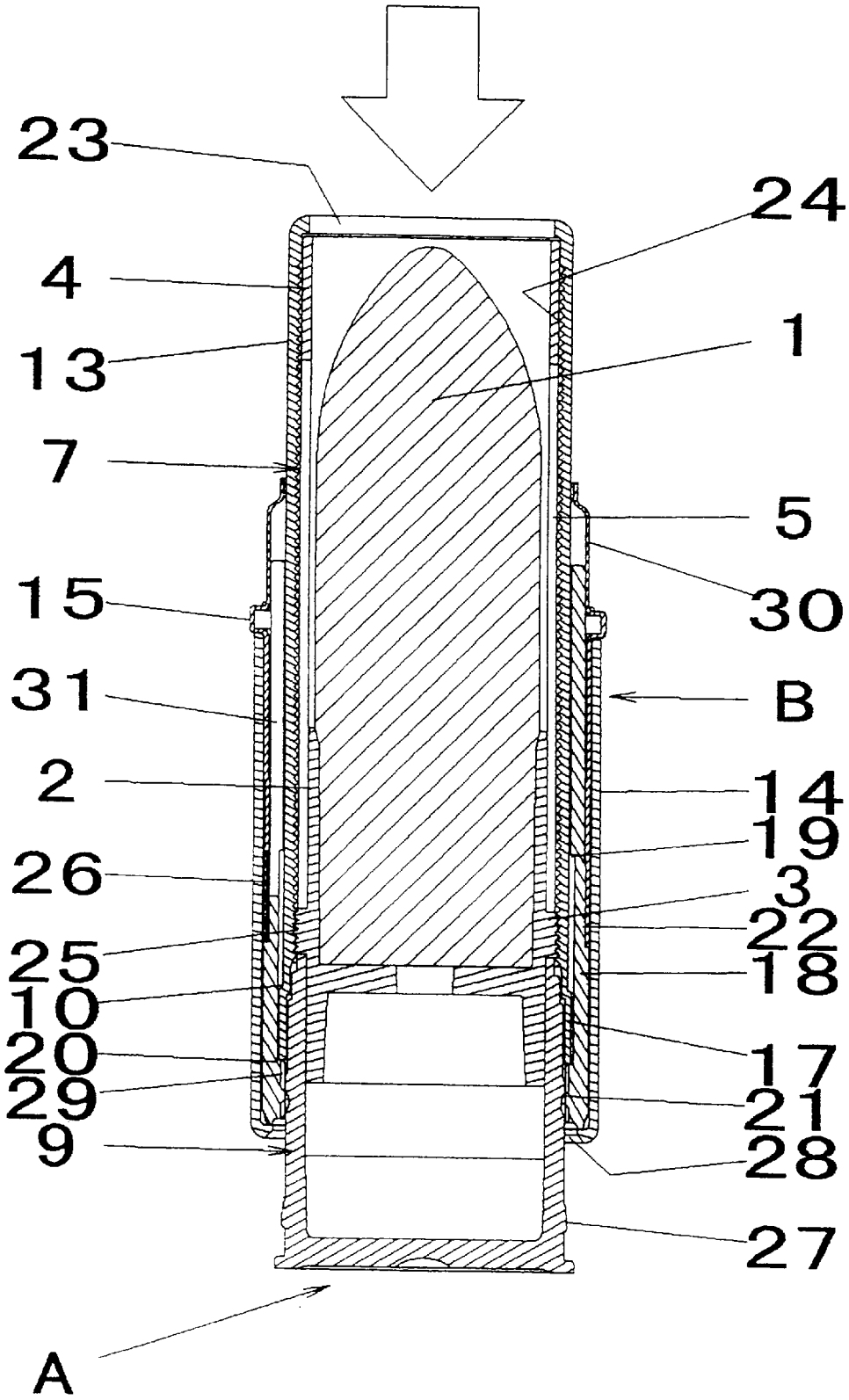
FIG. 4 is a longitudinal-sectional view showing a state in which the cartridge body is being removed.
Figure 5:
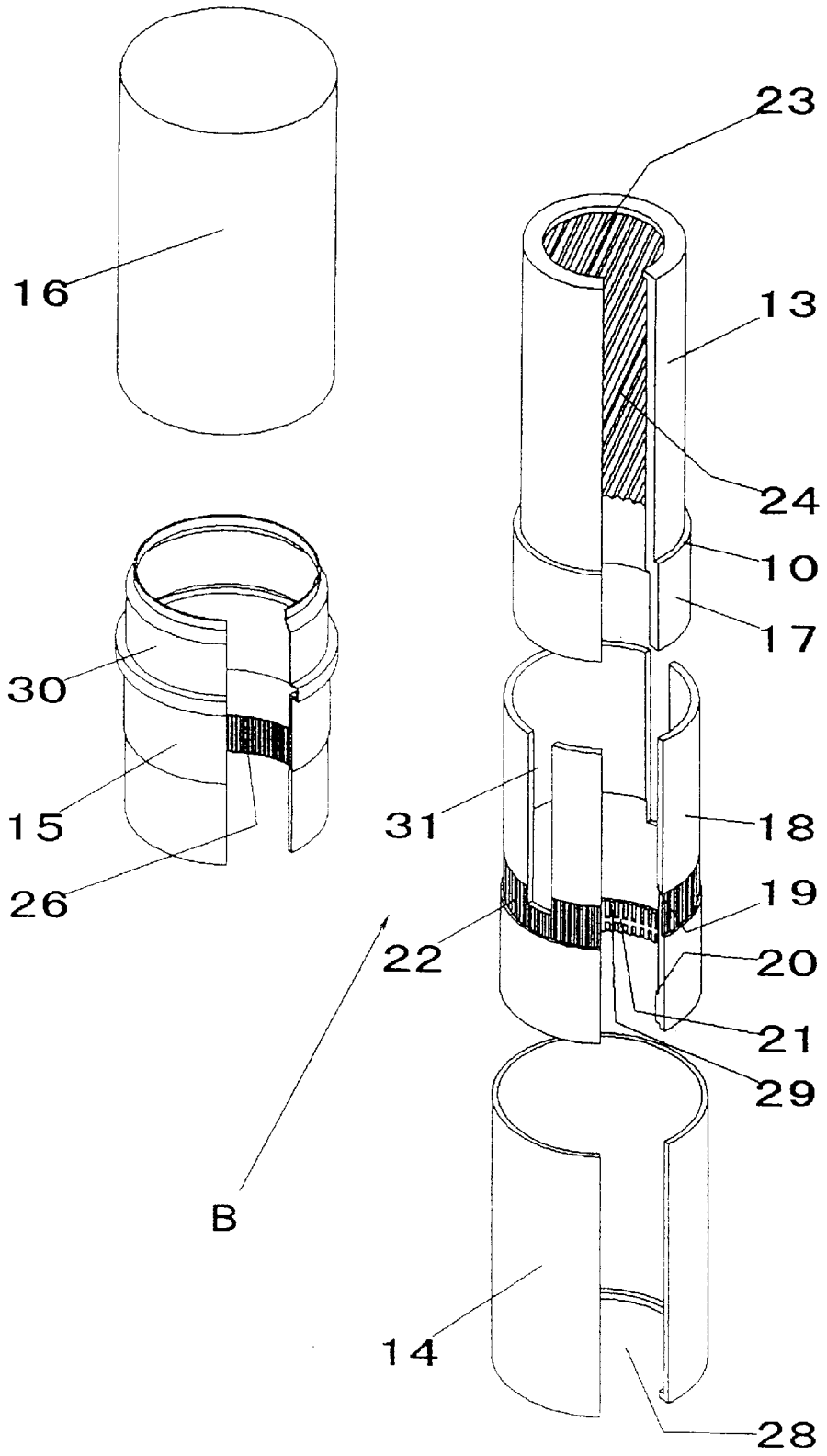
FIG. 5 is an exploded view of the container main body.

As a result, when the cartridge body A is inserted into the casing main body B from the opening 28 in the lower surface of the main body cylinder 14, the upper end of the inner body cylinder 4 is brought into abutment with the periphery of the opening 23 in the upper end of the sleeve 13, as shown in FIG. 2. The sleeve 13 is thereby pushed upwards such that the engaging projections 27 of the inner body cylinder 4 ride over the inner circumferential rib 21 and come into engagement between adjacent longitudinal ribs 29 to connect the cartridge body A is with the container main body B. In this instance, the sleeve 13 is prevented from a downward movement due to the abutment of the periphery of the opening 23 with the upper end of the inner body cylinder 4, and from an upward movement due to the abutment of the stepped portion 10 of the increased diameter portion 17 with the upper stopper 19 of the inner cylinder 18. Thus, the sleeve 13 cannot be moved vertically, and can only be rotated.

Figure 8:
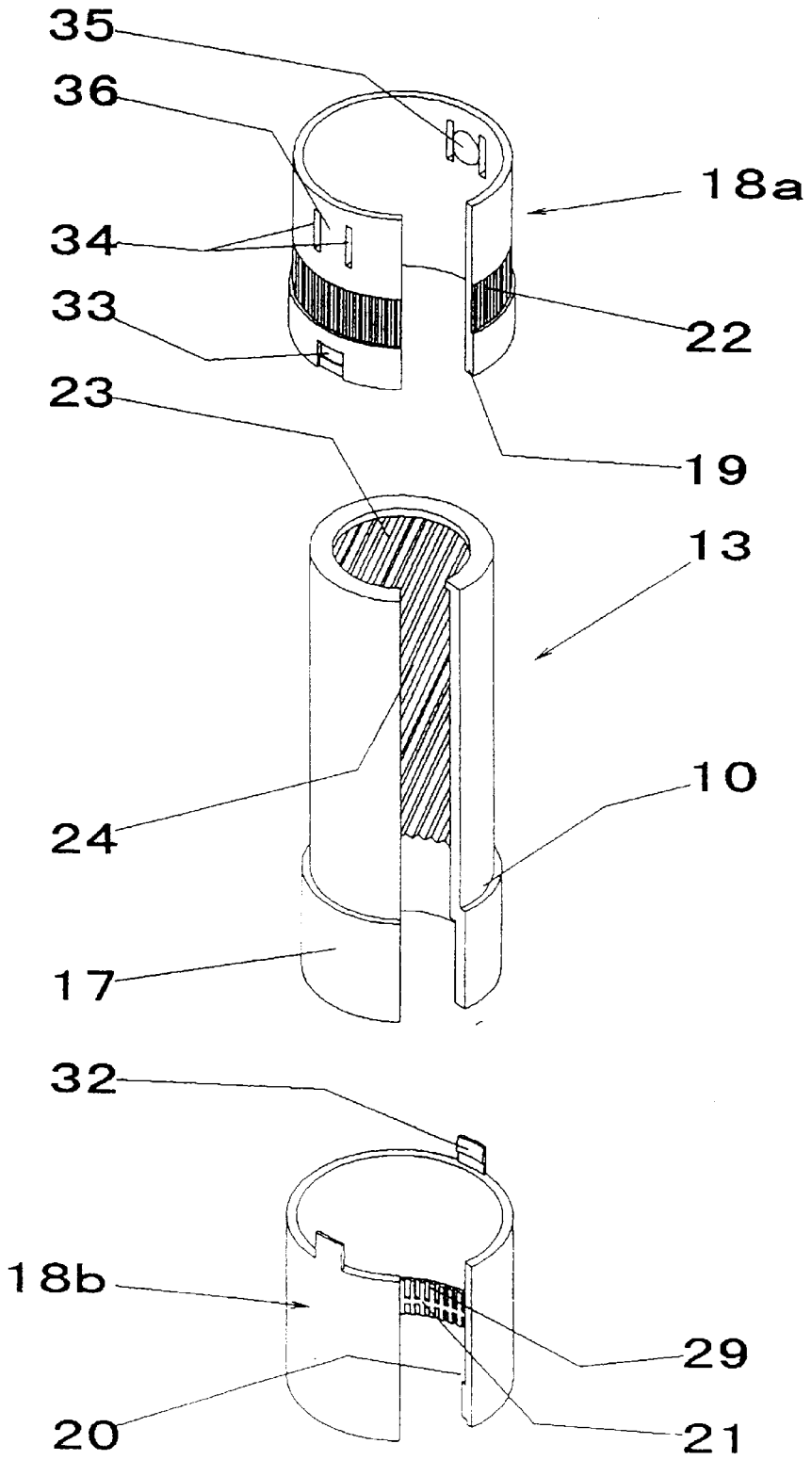
FIG. 8 is a perspective view showing another embodiment of the present invention in which the inner body cylinder is of a two-piece structure.

In the above-mentioned embodiment, as explained above, the inner cylinder 18 is provided with cutouts 31 in its upper end, in order to allow the increased diameter portion 17 of the sleeve 13 to be inserted into the inner cylinder 18. It is alternatively possible to adopt a modification in which, as shown in FIG. 8, the inner cylinder 18 is divided vertically into two pieces, at a location between the upper end lower stoppers 19, 20. In this instance, one of the opposite ends of the upper and lower cylinder portions 18*a*, 18*b* is provided with resilient hooks 32 and the other of the opposite ends is formed with corresponding recesses 33 in which the hooks 32 can be engaged. The sleeve 13 can be removably retained inside of the inner cylinder 18, by displacing the upper cylinder portion 18*a* downwards from the upper end of the sleeve 13 and also displacing the lower cylinder portion 18*b* upwards from the lower end of the sleeve 13 so that the hooks 32 are engaged into the recesses 33 and the upper and lower cylinder portions 18*a*, 18*b* are thereby connected to each other to form an integrated inner cylinder 18. When such inner cylinder 18 is accommodated into the main body cylinder 14, the hooks 32 are prevented from deformation by the inner wall of the main body cylinder 14, thereby making it impossible to disintegrate the inner cylinder 18. The peripheral wall of the upper cylinder portion 18*a* is formed with pairs of windows 34, and resilient portions 36 are formed between adjacent windows 34. The resilient portions 36 have respective inner walls formed as sliding projections 35 which can be resiliently brought into sliding contact with the outer wall of the sleeve 13. As a result, a sliding resistance is generated between the sleeve 13 and the inner cylinder 18 to prevent vertical rattling of the sleeve 13 when the container main body B alone is present, to improve user's operational feel during dispensing operation, to absorb dimensional tolerance between the sleeve 13 and the inner cylinder 18, and the like. The upper and lower cylinder portions 18*a*, 18*b* may be integrated with each other by different means, such as press-fitting, crimping, adhesion, etc.

Figure 9:
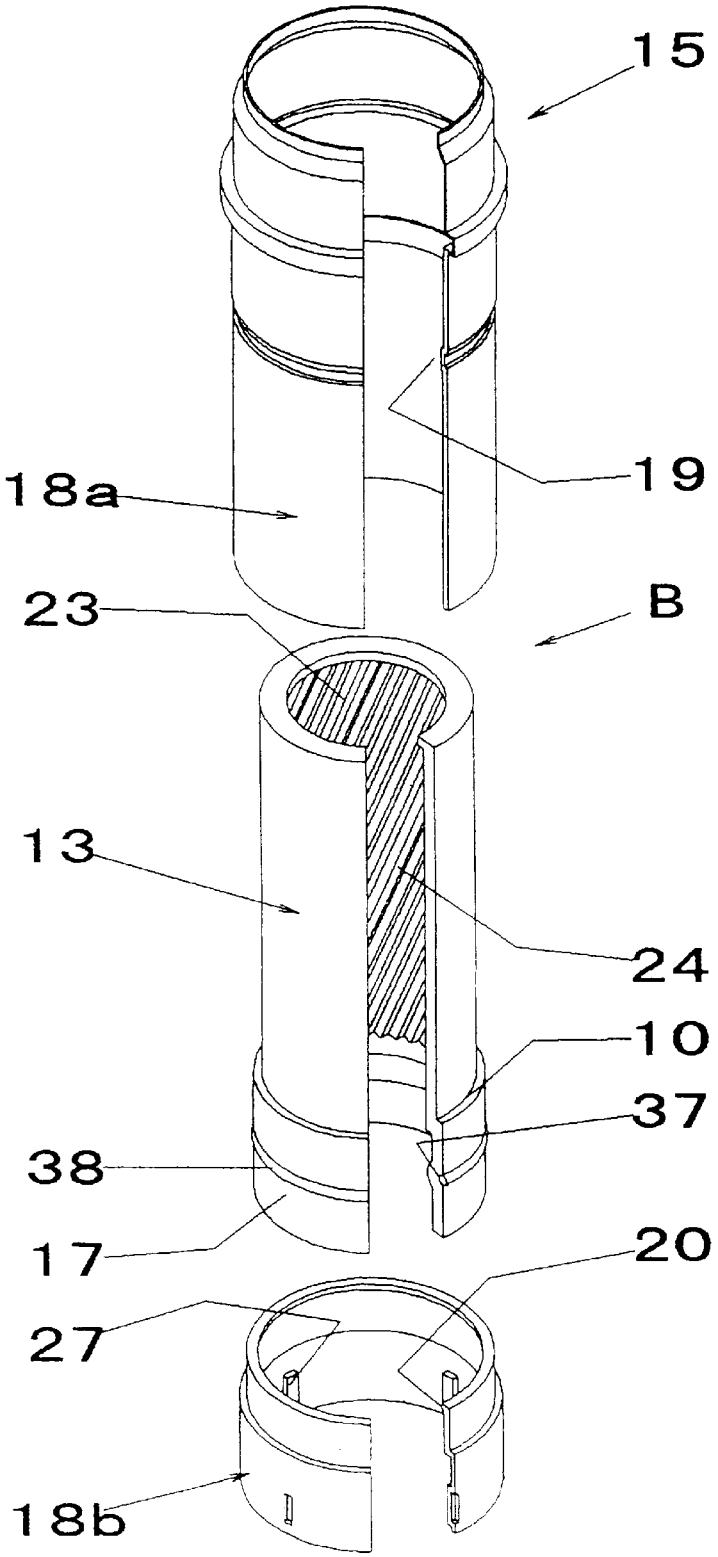
FIG. 9 is a perspective view showing another embodiment of the present invention in which the upper portion of the inner body cylinder is connected with the fitting cylinder.
Figure 10:
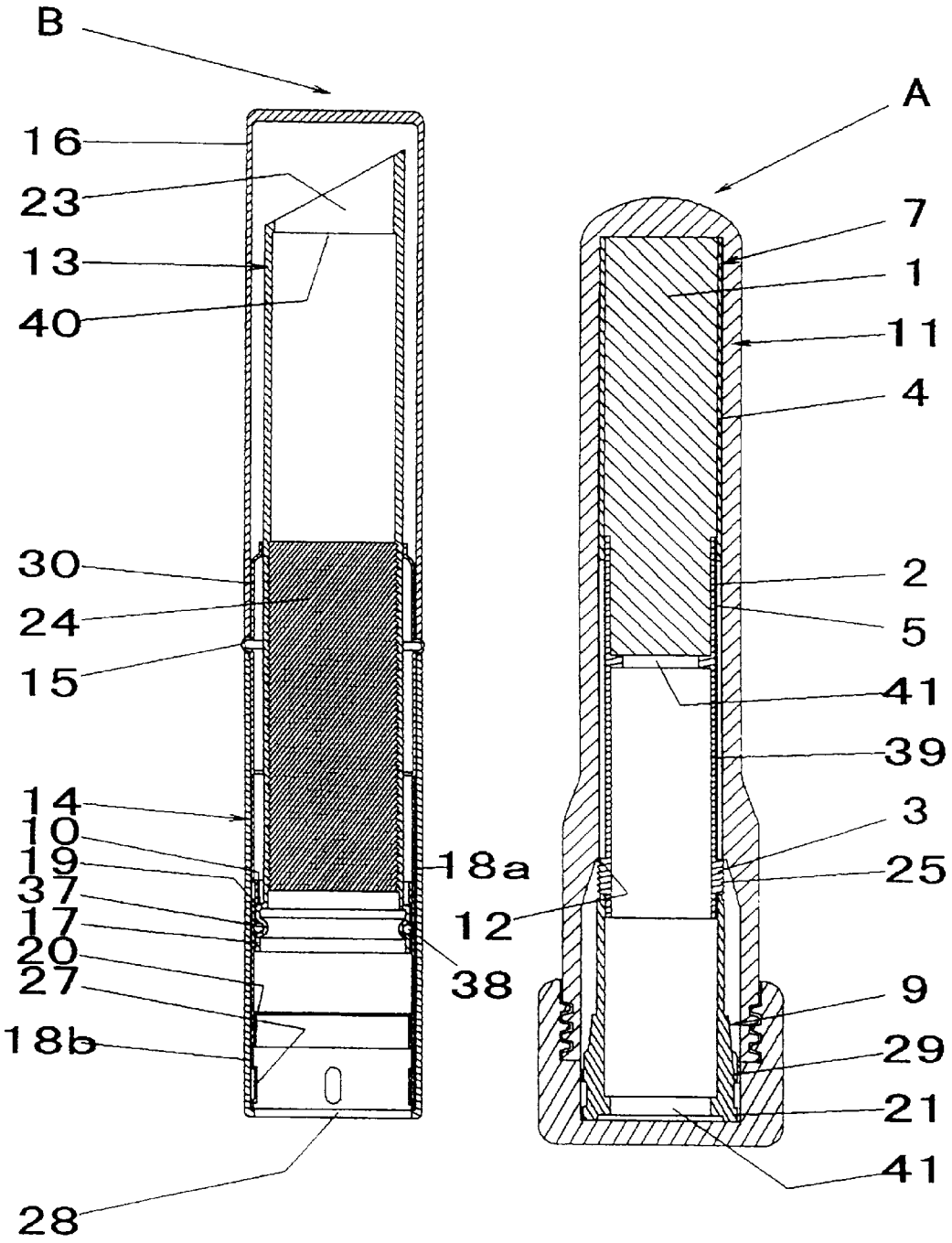
FIG. 10 is a longitudinal-sectional view showing the cartridge body and the container main body according to another embodiment of the present invention in which the cosmetic can be directly charged.
Figure 11:
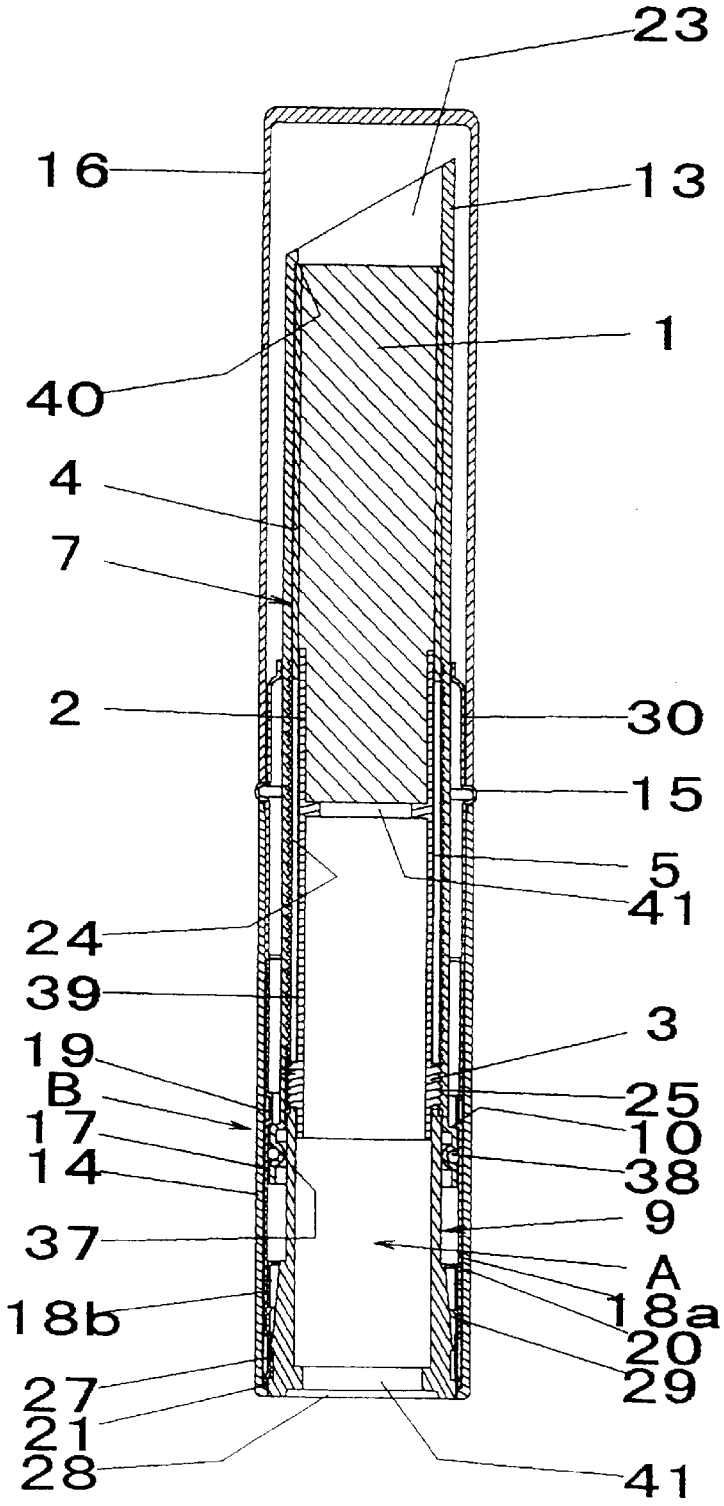
FIG. 11 is a longitudinal-sectional view showing a state in which the cartridge body of FIG. 10 has been placed in the container main body.

As means for generating sliding resistance between the sleeve 13 and the inner cylinder 18, it is also possible to arrange a resilient member, such as a rubber member, between the sleeve 13 and the inner cylinder 18, as shown in FIGS. 9–11. More particularly, the outer surface of the sleeve 13 at its increased diameter portion 17 is formed with a circumferential groove 37 and an O-ring 38 comprising a resilient material, such as elastomer, is arranged in the circumferential groove 38 such that the O-ring is resiliently brought into a sliding contact with the inner surface of the inner cylinder 18.

As further shown in FIGS. 9–11, it is also possible to integrally form the upper cylinder portion 18*a* with the fitting cylinder 15 which is secured to the upper portion of the main body cylinder 14. In this instance, the upper stopper 19 is provided on the inner wall at the lower portion of the fitting cylinder 15, and the upper cylinder portion 18*a* is constituted by the lower portion of the fitting cylinder 15. The lower cylinder portion 18*b* is secured to the lower end of the fitting cylinder 15. The sleeve 13 can be removably retained inside of the fitting cylinder 15 and the lower cylinder portion 18*b*, by inserting the sleeve 13 from the lower side of the fitting cylinder 15 and subsequently securing the lower cylinder portion 18*b* to the lower portion of the fitting cylinder 15. In this instance, it is of course that the fitting cylinder 15 and the inner cylinder 18 can be formed of appropriate plastic material. Alternatively, however, the fitting cylinder 15 and the inner cylinder 18 can be formed of metal so that the container main body B formed in its entirety of metal can be collected for recycling use. In this instance, it is necessary to provide the inner body cylinder 4 with the circumferential rib 21 and the longitudinal ribs 29, and to provide the lower cylinder portion 18*b* with the engaging projections 27.

As shown in FIGS. 10 and 11, the present invention can also be applied to a dispenser container for a rod-like cosmetic in which a cosmetic in a molten state is charged into inside of the inner body cylinder 4 and cooled and solidified into a rod-like cosmetic 1. In this instance, the holder cylinder 2 is provided with a leg cylinder 39 suspended downwards therefrom, and the peripheral wall of the leg cylinder 39 in its lower portion is provided with the engaging projections 3. As a result, since the engaging projections 3 are situated at a lower location, the guide slits 5 can be formed at the lower portion of the inner body cylinder 4 such that the upper ends of the guide slits 5 are situated below the upper end of the holder cylinder 2. The outer peripheral wall at the upper end of the holder cylinder 2 is arranged so as to be brought into sliding contact with the inner wall of the inner body cylinder 4, so that a cosmetic in a molten state can be charged into the inner body cylinder 4. Also, as shown in FIG. 10, the top surface of the temporary cap 11 fitted onto the inner body cylinder 4 is brought into abutment with the upper end of inner body cylinder 4 when the cartridge body A alone is present, and a through opening 41 communicating with inside of the inner body cylinder 4 is formed in the bottom surfaces of the holder cylinder 2 and the inner body cylinder 4, so that the cosmetic can be charged from the bottom surface of the inner body cylinder 4, with the inner body cylinder 4 placed upside-down. As for the sleeve 13, furthermore, the helical knurls 24 are arranged at the lower portion of the sleeve 13 corresponding to the guide slits 5 in the inner body cylinder 4 and a stepped portion 40 is formed on the inner wall at the upper portion of the sleeve 13 so that the tip end of the inner body cylinder 4 can be brought into engagement with the stepped portion 40. When the cartridge body A is mounted into the container main body B, the sleeve 13 is pushed up to its sliding upper limit position and held in place such that it is then unable to move upwards or downwards and to rotate.

As described above, according to the present invention, the container main body B is formed by providing the sleeve 13 with the helical knurls 24 for vertically moving the holder cylinder 2 and arranging the sleeve 13 in the main body cylinder 14 in a rotatable and vertically movable manner, while the cartridge body A is comprised of the holder cylinder 2 accommodating and holding the rod-like cosmetic 1, and of the inner body cylinder 4. The cartridge body A is mounted into the container main body B by securing the base region 9 of the inner body cylinder 4 to the main body cylinder 14 of the container main body B. Further, the cartridge body A can be removed by pushing the sleeve 13 downwards so that the tip end portion of the inner body cylinder 4 in abutment with the periphery of the opening 23 in the sleeve 13 is pushed downwards. Furthermore, when the cartridge body A is mounted in place, the tip end portion of the inner body cylinder 4 is brought into abutment with the periphery of the opening 23 and pushed upwards, and the abutment region 12 of the sleeve 13 is brought into abutment with the upper stopper 19 of the inner cylinder 12, to prevent the vertical movement of the sleeve 13. Therefore, when the cartridge body A has been mounted in the container main body B, the dispenser container for a rod-like cosmetic according to the present invention can be used exactly in the same manner as the conventional dispenser container.

The cartridge body A can be mounted into the container main body B by holding the main body cylinder 14 and urging the base region 9 of the inner body cylinder 4 onto a table, and removed therefrom by urging the sleeve 13 onto the table. Therefore, as compared to the case in which the cartridge body A is mounted or removed manually, it is possible to increase the retaining force between the main body cylinder 14 and the base region 9 of the inner body cylinder 4. As a result, the cartridge body A can be prevented from unintended removal. Also, due to the provision of the inner circumferential rib 21, the longitudinal ribs 29 and the engaging projections 27 engageable therewith, the feel of the engaging projections 27 riding over the inner circumferential rib 21 during the mounting operation of the cartridge body A is transmitted to the user's hand, thereby providing a secured operational feel to users. Further, the engagement of the engaging projections 27 between the longitudinal ribs 29 serves to positively retain the cartridge body A in the container main body B in a manner in which it is prevented from rotation or removal.

The provision of a number of helical knurls 24 over the entire periphery of the inner wall of the sleeve 13, and of the engaging surface 25 at the radially outer ends of the engaging projections 3 of the holder cylinder 2 so as to be engageable with the helical knurls 24 ensures that the helical knurls 24 and the engaging projections can be engaged with each other at any desired location. Thus, when the cartridge body A is mounted into place, a burdensome positioning between the helical knurls 24 and the engaging projections 3 can be dispensed with, so that the mounting operation can be performed in a further facilitated manner.

Since, during the mounting of the cartridge body A, the tip end of the inner body cylinder 4 is brought into abutment with the periphery of the opening 23 for passing the sleeve therethrough, it is not required to provide the stepped portion 10 on the peripheral wall of the inner body cylinder 4, and it is thus possible to realize a slender arrangement of the inner body cylinder 4. Moreover, the inside of the container main body is completely free from a stepped portion so that the mounting operation of the cartridge body A can be performed in a further facilitated manner. Also, since the guide slits are made to have a large width such that the holder cylinder 2 can be assembled into the inner body cylinder 4 through the guide slit 5, it is not required to form cutouts at the tip end of the inner body cylinder, and it is thus possible to improve the strength at the tip end of the inner body cylinder 4. Accordingly, even when the sleeve 13 is pushed upwards by the tip end of the inner body cylinder 4, it is possible to prevent deformation of the tip end of the inner body cylinder 4 or damages to the rod-like cosmetic accommodated in the inner body cylinder 4.

While the present invention has been described above with reference to specific embodiments, it is of course that they have been presented by way of examples only, and various modifications and/or alterations are possible without departing from the scope of the invention as defined by the appended claims.

What is claimed is:

1. A dispenser container for a rod-like cosmetic, which comprises a cartridge body (A) which accommodates a rod-like cosmetic (1) and includes a holder cylinder (2) having a peripheral wall provided with engaging projections (3), and an inner body cylinder (4) in which the holder cylinder (2) is vertically movably arranged, said inner body cylinder (4) having a peripheral wall provided with guide slits (5) through which the engaging projections (3) extend, for guiding said holder cylinder (2) while preventing rotation relative to each other; and a container main body (B) which includes a main body cylinder (14) having an upper portion provided with a fitting portion (30) for detachably fitting a cap (16), and a sleeve (13) rotatably held by said main body cylinder (14) and having an inner wall provided with helical knurls (24) which are engageable with the engaging projections (3) of the holder cylinder (2); said cartridge body (A) being inserted into the container main body (B) such that a base region (9) of said inner body cylinder (4) of the cartridge body (A) is detachably engaged within said main body cylinder (14) of the container main body (B), wherein:

said sleeve (13) of the container main body (B) is accommodated within said main body cylinder (14) such that the sleeve (13) is rotatable and vertically movable within a predetermined range, said sleeve (13) having a peripheral portion which defines an opening (23) and said inner body cylinder (4) having an upper end which can be brought into abutment with said peripheral portion of the sleeve, such that said sleeve (13) is retained in place in which the sleeve (13) is rotatable but prevented from vertical movement, after said cartridge body (A) has been inserted into said container main body (B) and the sleeve (13) has been pushed upwards to its upper limit position.

2. The dispenser container for a rod-like cosmetic according to claim 1, wherein said holder cylinder (2) is provided with a leg cylinder (39) suspended downwards therefrom and having a peripheral wall, said engaging projections (3) being arranged at a lower portion of said peripheral wall of the leg cylinder (39), said guide slits (5) having upper ends which are arranged at a location below an upper end of said holder cylinder (2) such that a cosmetic in a molten state can be charged into said inner body cylinder (4).

3. The dispenser container for a rod-like cosmetic according to claim 2, wherein said inner wall of the sleeve (13) has an upper portion provided with a stepped portion (40) with which the tip end of said inner body cylinder (4) can be brought into abutment, such that said sleeve (13) is retained in place in which the sleeve (13) is rotatable but prevented from vertical movement, after said cartridge body (A) has been inserted into said container main body (B) and the sleeve (13) has been pushed upwards to its upper limit position.

4. The dispenser container for a rod-like cosmetic according to claim 1, wherein said inner wall of the sleeve (13) is provided with a number of helical knurls (24), said engaging projections (3) of the holder cylinder (2) each having a radially outer surface (25) which can be engaged with a plurality of knurls (24) which are adjacent to each other.

5. The dispenser container for a rod-like cosmetic according to claim 1, wherein at least one of said guide slits (5) of the inner body cylinder (4) is closed at its both ends and has a width which is slightly smaller than an outer diameter of said holder cylinder (2) such that the holder cylinder (2) can be inserted into the inner body cylinder (4) when the inner body cylinder (4) is deformed and said at least one guide slit (5) is expanded to have an increased width, said engaging projections (3) on the peripheral wall of the holder cylinder (2) having a width which corresponds to the width of said guide slits (5), and being engaged with the guide slits (5) for guiding a vertical movement of the holder cylinder (2) while preventing rotation of the holder cylinder (2).

6. The dispenser container for a rod-like cosmetic according to claim 1, wherein said sleeve (13) has a lower portion which is provided with an increased diameter portion (17) having a relatively large outer diameter, said increased diameter portion (17) defining a stepped portion (10), and said main body cylinder (14) is provided therein with an upper cylinder (19) with which said stepped portion (10) of the sleeve (13) can be brought into abutment for defining the upper limit position of said sleeve (13), and also with a lower stopper (20) with which the lower end of said sleeve (13) can be brought into abutment for defining the lower limit position of said sleeve (13).

7. The dispenser container for a rod-like cosmetic according to claim 6, wherein an inner cylinder (18) is accommodated in said main body cylinder (14) and said upper stopper (19) and said lower stopper (20) are provided on an inner wall of said inner cylinder (18), and an engaging mechanism for detachably engaging with said cartridge body (A) is provided on a lower portion of said inner wall of said cylinder (18).

8. The dispenser container for a rod-like cosmetic according to claim 6, wherein said inner cylinder (18) is provided with a cutout (31) which extends from the upper end of said inner cylinder (18) to a location below said upper stopper (19), for allowing said upper stopper to be expanded such that said increased diameter portion (17) of the sleeve (13) can be inserted therethrough.

9. The dispenser container for a rod-like cosmetic according to claim 6, wherein said inner cylinder (18) is divided into an upper cylinder portion (18*a*) and a lower cylinder portion (18*b*) at a location between said upper stopper (19) and said lower stopper (20), said upper and lower cylinder portions (18*a*, 18*b*) being integrally connected to each other after said sleeve (13) has been mounted into said inner cylinder (18).

10. The dispenser container for a rod-like cosmetic according to claim 9, wherein a fitting cylinder (15) having a fitting portion (30) is secured to an upper portion of said main body cylinder (14), said fitting cylinder (15) having a lower portion with respect to which said upper cylinder portion (18*a*) of said inner cylinder (18) is arranged in a contiguous manner.

11. The dispenser container for a rod-like cosmetic according to claim 9, wherein said upper cylinder portion (18*a*) of said inner cylinder (18) has an inner wall provided with at least one projection (35) which is capable of achieving a sliding contact, under a resilient force, with an outer peripheral wall of said sleeve (13) such that the vertical movement and the rotation of said sleeve (13) are accompanied by a defined sliding resistance.

12. The dispenser container for a rod-like cosmetic according to claim 6, wherein a resilient O-ring (38) is arranged on the outer peripheral surface of said increased diameter portion (17), said O-ring (38) being capable of achieving a sliding contact, under a resilient force, with an outer peripheral wall of said sleeve (13) such that the vertical movement and the rotation of said sleeve (13) are accompanied by a defined sliding resistance.

* * * * *

UNITED STATES PATENT AND TRADEMARK OFFICE

CERTIFICATE OF CORRECTION

PATENT NO. : 6,082,372

DATED : July 4, 2000

INVENTOR(S) : T. MIZUKAKI

It is certified that error appears in the above-identified patent and that said Letters Patent is hereby corrected as shown below:

On the cover of the printed patent, at Item [56], References Cited, U.S. Patent Documents, line 6, "3,230,860" should be ---3,230,960---.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*